US007077669B1

(12) United States Patent
Walters

(10) Patent No.: US 7,077,669 B1
(45) Date of Patent: Jul. 18, 2006

(54) SNAP-IN CONNECTOR FOR AIRCRAFT WEAPONS TEST SET

(75) Inventor: James Craig Walters, Cresson, TX (US)

(73) Assignee: Williams-Pyro, Inc., Fort Worth, TX (US)

( * ) Notice: Subject to any disclaimer, the term of this patent is extended or adjusted under 35 U.S.C. 154(b) by 0 days.

(21) Appl. No.: 11/064,710

(22) Filed: Feb. 24, 2005

(51) Int. Cl.
*H01R 25/00* (2006.01)

(52) U.S. Cl. ..... 439/121; 439/122

(58) Field of Classification Search ..... 439/94, 439/116, 121, 122, 372
See application file for complete search history.

(56) References Cited

U.S. PATENT DOCUMENTS 4,032,208 A * 6/1977 Berkenhoff ..... 439/122
4,904,200 A 2/1990 Williams
4,914,061 A 4/1990 Williams
5,013,254 A 5/1991 Williams et al.
5,129,837 A 7/1992 Williams
5,151,038 A * 9/1992 Range et al. ..... 439/122
6,568,949 B1 5/2003 Walters

FOREIGN PATENT DOCUMENTS

EP 000465883 A1 * 2/1992

* cited by examiner

*Primary Examiner*—Khiem Nguyen
(74) *Attorney, Agent, or Firm*—Geoffrey A. Mantooth

(57) ABSTRACT

A connector for a weapons test set circuit has a case with an open end and electrical conductors extending from the open end into and through the case. The connector is designed to connect to a rail and has coupling legs for this purpose. Each coupling leg has a base portion located in the case and an extension portion that extends out of the case and diverges from the other extension portion. The base portions can move toward each other or apart from each other along guides and are biased in the apart position. Buttons extend from the base portions out of the case; an operator depresses the buttons to converge the legs to allow insertion or removal of the connector from the rail. Releasing the buttons causes the legs to move to the apart position.

7 Claims, 4 Drawing Sheets

SNAP-IN CONNECTOR FOR AIRCRAFT WEAPONS TEST SET

FIELD OF THE INVENTION

The present invention relates to test sets for aircraft weapons systems, and in particular to connectors for said test sets.

BACKGROUND OF THE INVENTION

An F-16 fighter aircraft has a weapons rail at the end of each wing. The rail receives a missile, such as the AIM-9 (Sidewinder), an air-to-air missile.

Inside of the rail are electrical contacts used for firing the weapon. The electrical contacts are connected to a weapons firing circuit, operated from the cockpit of the aircraft.

Aircraft weapons systems are frequently tested in order to ensure reliability. The liability can literally be the difference between life and death, as a pilot engaged in air-to-air combat is disadvantaged by a missile that will not fire when commanded to do so.

The weapons circuit is tested, when the aircraft is on the ground, by locating a connector in the rail so as to make contact with the electrical contacts. The connector is part of a test set.

In the prior art, positioning the test set connector in the rail is time consuming and laborious. The connector is inserted into the end of the rail and then slid to where the contacts are. Unfortunately, the ends of the rail are not normally accessible and are covered by part of the wing, necessitating disassembly of the wing in order to access the end of the rail to allow insertion of the connector. This disassembly adds to the time and labor in testing the weapons circuit. In addition, aircraft maintenance practice prefers that onboard electrical circuits be tested with a minimum amount of disassembly of the aircraft.

SUMMARY OF THE INVENTION

It is an object of the present invention to provide a weapons test set connector that can be located in a weapons rail without the need to disassemble parts of the aircraft.

The present invention provides a connector for a weapons test circuit comprising a case having an open end. Electrical connectors extend through the case and terminate in contacts at the open end. The contacts are positioned at the open end by an insulating insert. Coupling legs are structured and arranged to couple to a rail. Each coupling leg has a base portion located in the case and an extension portion extending from the base portion. The base portion of each rail moves translationally along a guide in the case. The extension portions extend from the case and diverge from each other. The legs can move to a close position that allows the connector to be inserted into and removed from the rail and the legs can be moved to an apart position to assist in coupling the connector to the rail.

In accordance with one aspect of the present invention, the legs are biased in the apart position.

In accordance with another aspect of the present invention, the legs are biased in the apart position by way of the spring extending between the base portions.

In accordance with still another aspect of the present invention, each leg is shaped like an "L" in transverse cross-section.

In accordance with still another aspect of the present invention, the guide comprises two guide members, with the electrical conductors extending between the guide members.

In accordance with still another aspect of the present invention, there are provided closure members coupled to the base portions, which closure members extend through the case.

DESCRIPTION OF THE PREFERRED EMBODIMENT

Figure 1:
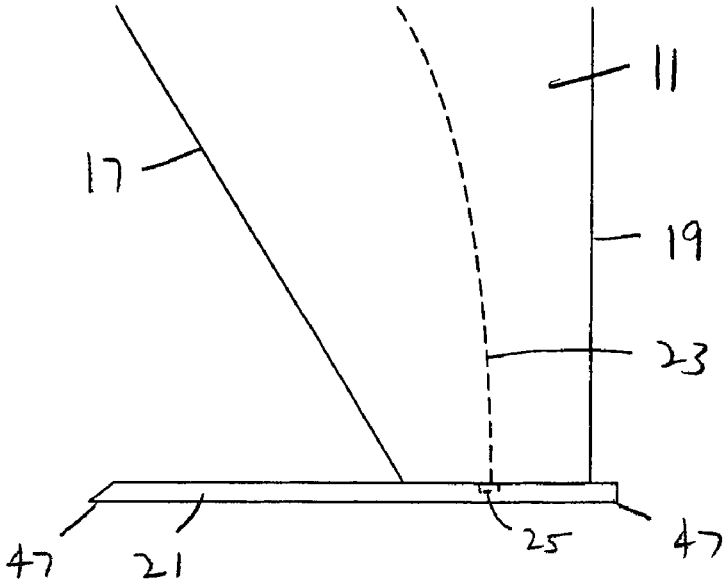
FIG. 1 shows the end of an aircraft wing and a weapons rail, for which the test set of the present invention is used.
Figure 2:
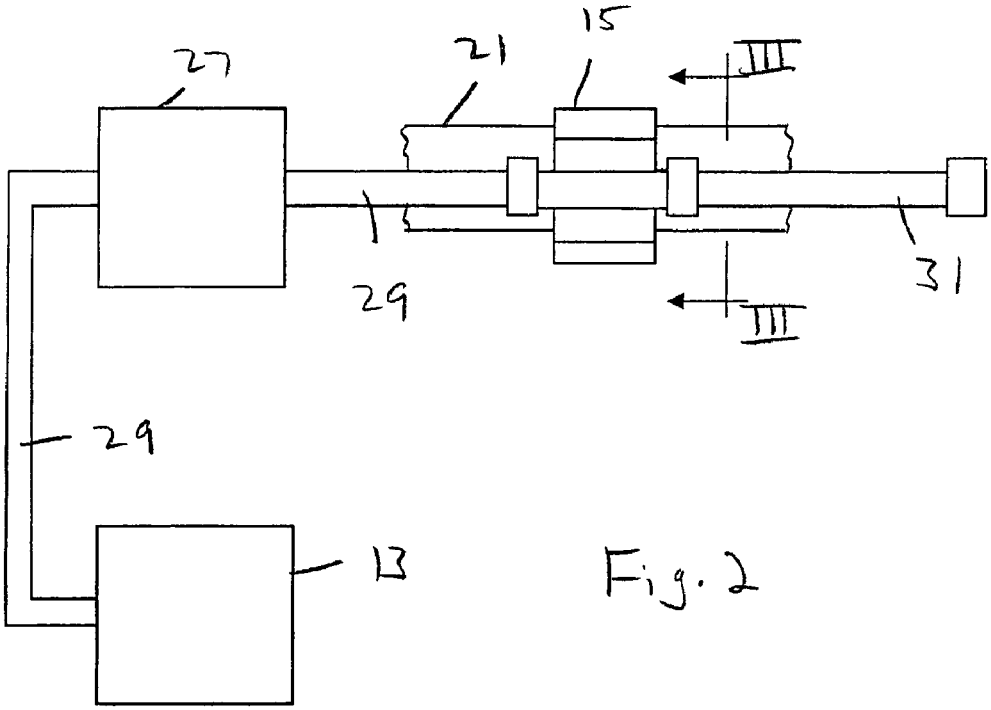
FIG. 2 is an end view of the wing of FIG. 1, showing part of the rail and a weapons test set, including a connector for the rail.

FIGS. 1 and 2 show an aircraft wing 11 and a test circuit 13, for which the rail connector 15 of the present invention is particularly suited. The aircraft is an F-16 fighter. The end portion of the left wing 11 is shown in FIG. 1. The wing 11 has a leading edge 17 and a trailing edge 19. At the end of the wing 11 is a rail 21, which rail receives a weapon, such as an AIM-9 missile (also known as a Sidewinder).

The test set 13 connects to and checks the electrical circuit 23 that is used to fire the rail-mounted weapon. The electrical circuit extends from the electrical contacts 25 in the rail to the aircraft cockpit (in FIG. 1, the electrical circuit is shown schematically). The electrical circuit is accessed by mounting the rail connector 15 in the rail. Mounting the test set rail connector 15 in the rail 21 is the subject of the present invention.

Before discussing the specifics of the test set rail connector 15, the test set 13 will be described, as will the prior art rail connector. The test set 13 contains electrical circuitry to test the continuity, voltages and currents of the aircraft electrical circuit 23. The test set is conventional. The test set 13 connects to a rotary switch 27, which rotary switch in turn connects to the rail connector 15. The rail connector has two electrical contacts that make electrical contact with the two exposed contacts 25 in the rail 21. The test set 13, rotary switch 27 and rail connector 15 are connected to one another by cable harnesses 29. The rail connector 15 is also connected to another cable harness 31, which cable harness connects to another part of the aircraft electrical circuit.

Figure 3:
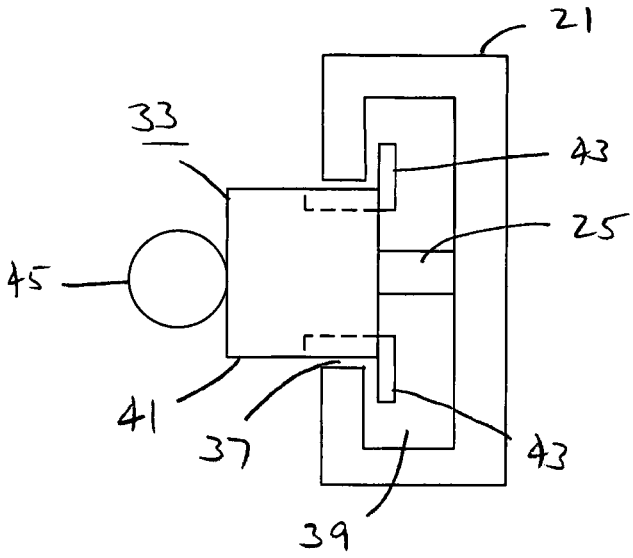
PRIOR ART Fig. 3
FIG. 3 is a cross-sectional view of the rail of FIG. 2, taken through lines III—III thereof, and showing a prior art test connector.

FIG. 3 shows the prior art rail connector 33 in the aircraft rail 21. The rail forms somewhat of a "C" shape (FIG. 3 shows a backward "C"), having a narrow opening 37 and a wider inside chamber 39. The opening 37 and the chamber 39 extend for the length of the rail. The electrical circuit contacts 25 are located in the rail, inside the chamber 39. The prior art rail connector 33 has a case 41 and two legs 43. The case 41 extends into the opening 37 of the rail 21. The legs are on opposite sides of the case and diverge with respect to one another. The legs 43 cooperate with the rail so as to hold the test connector in place. On the opposite side of the case from the two legs, a coupler 45 is provided. The coupler 45 receives wires that connect to the rail contacts. The coupler couples to test set harnesses 29, 31 (see FIG. 2).

The legs 43 are fixed to the case 41. The only way to install or remove the prior art rail connector 33 is from an end 47 (see FIG. 1) of the rail 21. The present invention allows the rail connector 15 to be installed or removed from the rail at an intermediate location of the rail.

Figure 5:
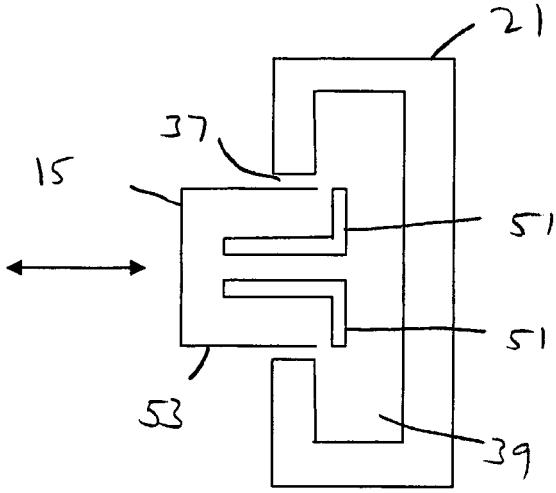
FIG. 5 is a schematic view of the test connector of FIG. 4, shown with the legs in the retracted position, for removing or installing the test connector in the rail.
Figure 4:
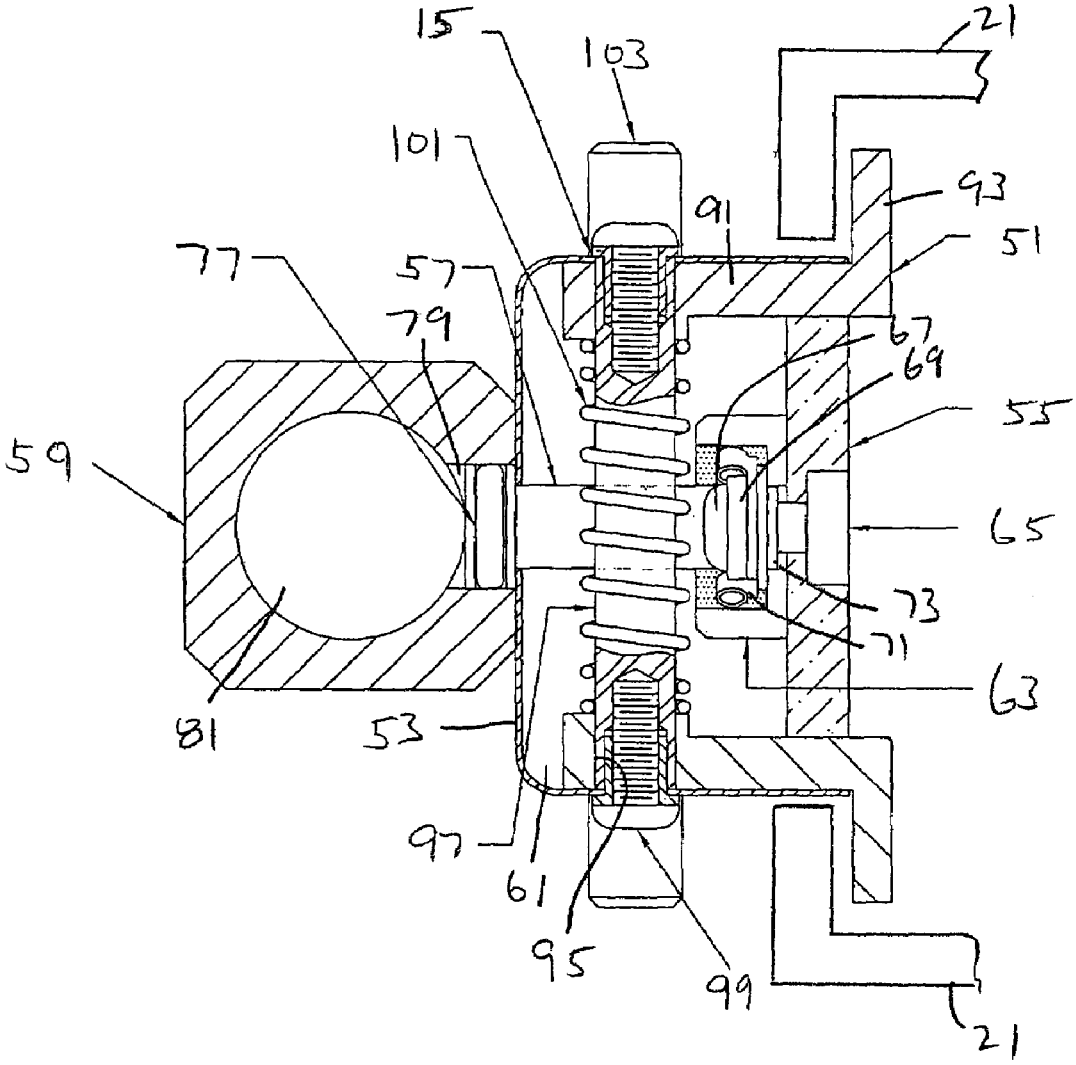
FIG. 4 is a cross-sectional view of the test connector of the present invention, in accordance with a preferred embodiment, shown in an engaged configuration for engaging the rail. The cross-section of the test connector is taken through lines IV—IV of FIG. 6.
Figure 6:
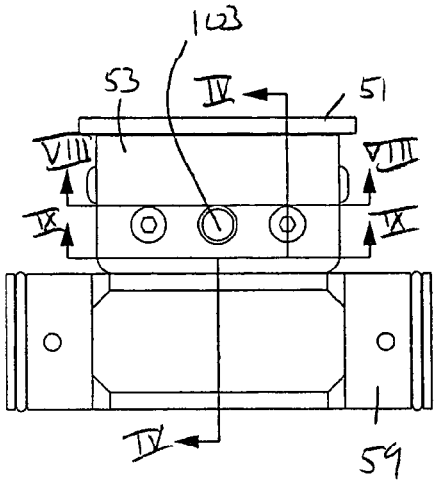
FIG. 6 is a plan view of the test connector.

Referring to FIGS. 4 and 5, the rail connector 15 of the present invention provides legs 51 that are movable with respect to the case 53. Normally, the legs 51 are separated by a distance (see FIG. 4) suitable for coupling to the rail 21. This is known as the apart position. The legs 51 can be brought closer (see FIG. 5) so as to decrease the distance between the legs. This position, known as the close position, allows the rail connector to be inserted into, or removed from, the rail 21 through the narrow opening 37, at or near the rail contacts 25. Thus, access to an end 47 in the rail 21 is not necessary to insert or remove the rail connector 15.

The rail connector 15 will now be described in detail. Referring to FIG. 4, the rail connector 15 has legs 51, a case 53, an insert 55, a tube 57 and a coupler 59.

The case 53 or body forms a box or housing that is open on one side. The case 53 has an interior cavity 61. The legs 51 extend from the cavity 61 out through the open side. The insert 55 is also located in the case, so as to be flush with the case edges that define the open side. The insert 55 is retained within the case by a tray 63. The ends of the tray are secured to the sides of the case 53 between the legs 51.

Figure 8:
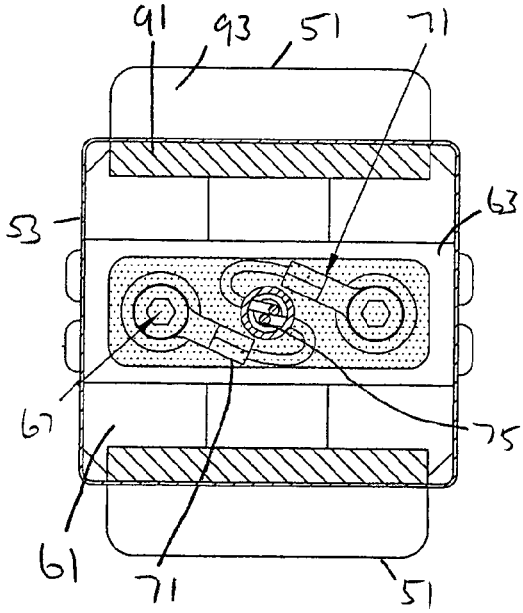
FIG. 8 is a cross-sectional view of the test connector, taken through lines VIII—VIII of FIG. 6.

The insert 55 is an insulator and has two contacts 65 mounted therein. As shown in FIG. 4, the contacts 65 extend through the insert 55 into the tray 63. The contacts 65 are exposed on the outside of the insert 55. The tray 63 is in contact with the inside of the insert 55. On the inside of the tray, each contact is secured to the insert by a screw 67, a washer 69, a terminal 71 and a shoulder washer 73 (see FIG. 8). The shoulder washer 73 fits in the opening of the tray 63. The interior of the tray can be potted. As shown in FIGS. 4 and 8, a wire 75 extends from the terminal through the tube and into the coupler. Each contact 65 has its own wire 75.

The tube 57 extends from the tray 63 through the case 53 into the coupler 59. The end 77 of the tube 57 is enlarged in diameter and receives an O-ring. The end of the tube 77 and O-ring are received by a cylindrical opening 79 in the coupler 59 which coupler communicates with the longitudinal opening 81 through the coupler 59. The coupler connects to the harnesses 29, 31 (see FIG. 2). The coupler is secured to the case by screws (not shown).

The insert 55, contacts 65, tube 57 and coupler 59 are fixed relative to the case 53.

Figure 7:
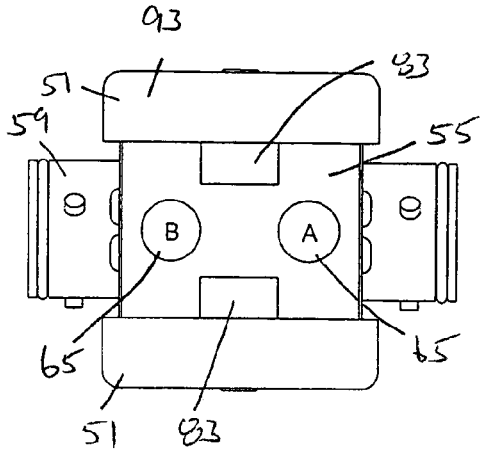
FIG. 7 is a view of the test connector in the engaged configuration as seen from the rail.

The insert 55 is shaped like an "H" in plan view, as shown in FIG. 7. Thus, the insert 55 has slots 83 therein. The slots 83 allow the legs 51 to move closer together.

Each leg 51 has a base portion 91 and an extension portion 93 (see FIG. 4). Both portions 91, 93 are plates and are oriented perpendicular to each other, so as to form an "L" shape when viewed in cross-section, as shown in FIG. 4. The base portions 91 are located inside of the case 53, while the extension portions 93 extend from the case to engage the rail 21.

Figure 9:
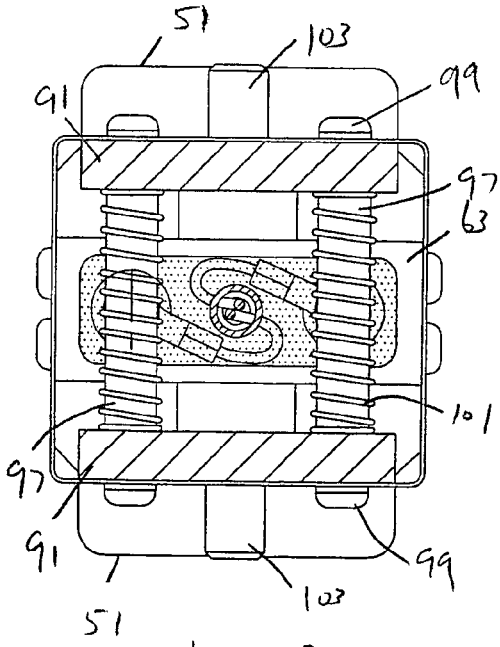
FIG. 9 is a cross-sectional view of the test connector, taken through lines IX—IX of FIG. 6.

Each base portion 91 has two holes 95 formed therethrough. The holes 95 receive guides 97. In the preferred embodiment, the guides 97 are shafts that extend from one side wall of the case to the opposite side wall, where the ends of the shafts are secured by screws 99. The base portion 91 is thicker at the holes 95 so as to provide a longer hole and therefore a longer bearing surface against the respective shaft. The tube 57 and the wires 75 therein extend between the shafts 97 (see FIG. 9). Helical springs 101 extend along the shafts 97 between the leg based portions. The springs 101 bias the legs in the apart condition, shown in FIG. 4, wherein the base portions 91 contact the case 53 wall. Each base portion 91 couples to a closure member, such as a button 103. The button 103 extends through the case and is accessible from the outside. As shown in FIG. 9, the buttons 103 are aligned on the same axis; this requires less force to move the legs to the close position.

The base portions 91 have notches (not shown) formed therein, which notches receive the insert 55.

In operation, the rail connector 15 is positioned at a location along the rail 21 by the contacts 25. To install the rail connector, the buttons 103 are depressed by the operator into the case 53. This action forces the leg base portions 91 together translationally along the shafts 97; the legs 51 retract to the close position. The connector can now be placed into the rail.

Releasing the buttons 103 allows the springs 101 to extend the legs to the apart position, wherein the rail connector is secured to the rail. To move the rail connector along the length of the rail, the buttons are depressed slightly to loosen the coupling between the legs and the rail and the connector can be repositioned. Once the connector is repositioned, such as on the contacts 25, the buttons are released. The circuit test can now be conducted.

Removing the rail connector from the rail involves the same process of retracting the legs by pressing the buttons, wherein the connector is then pulled out of the rail.

The foregoing disclosure and showings made in the drawings are merely illustrative of the principles of this invention and are not to be interpreted in a limiting sense.

The invention claimed is:

1. A connector for a weapons test circuit, comprising:

a) a case having an open end;

b) electrical connectors extending through the case and terminating in contacts at the open end, the contacts being positioned at the open end by an insulating insert;

c) coupling legs structured and arranged to couple to a rail;

d) each coupling leg having a base portion located in the case and an extension portion extending from the base portion, the base portion of each leg moving translationally along a guide in the case, the base portions moving independently of each other, the extension portions extending from the case and diverging from each other, wherein the legs can move to a close position that allows the connector to be inserted into and removed from the rail and the legs can be moved to an apart position to assist in coupling the connector to the rail;

e) a closure member for each coupling leg, each closure member coupled to the base portion of the respective leg, the closure member extending through the case, the closure members moving the legs in opposite directions.

2. The connector of claim 1 wherein the legs are biased in the apart position.

3. The connector of claim 2 wherein the legs are biased in the apart position by way of a spring extending between the base portions.

4. The connector of claim 1 wherein each leg is shaped like an "L" in transverse cross-section.

5. The connector of claim 1 wherein the guide comprises two guide members, with the electrical conductors extending between the guide members.

6. The connector of claim 1, wherein:

a) the legs are biased in the apart position by way of a spring extending between the base portions;

b) the guide comprises two guide members, with electrical conductors extending between the guide members.

7. The connector of claim 1 wherein the extension portions of the legs are coplanar to each other.

* * * * *